US006210463B1

(12) United States Patent
George et al.

(10) Patent No.: US 6,210,463 B1
(45) Date of Patent: Apr. 3, 2001

(54) PROCESS AND APPARATUS FOR THE CONTINUOUS REFINING OF BLISTER COPPER

(75) Inventors: David B. George, Salt Lake City, UT (US); Philip J. Gabb; John F. Castle, both of Bristol (GB); Torstein Utigard, Mississauga (CA)

(73) Assignee: Kennecott Utah Copper Corporation, Magna, UT (US)

( * ) Notice: Subject to any disclaimer, the term of this patent is extended or adjusted under 35 U.S.C. 154(b) by 0 days.

(21) Appl. No.: 09/241,143

(22) Filed: Feb. 1, 1999

Related U.S. Application Data

(60) Provisional application No. 60/074,515, filed on Feb. 12, 1998.

(51) Int. Cl.[7] ..... C22B 15/06

(52) U.S. Cl. ..... 75/640; 75/643; 75/644; 75/645; 266/160; 266/186

(58) Field of Search ..... 75/640, 643, 644, 75/645; 266/160, 186

(56) References Cited

U.S. PATENT DOCUMENTS

| | | | | |
|---|---|---|---|---|
| 3,460,817 | * | 8/1969 | Brittingham | 75/643 |
| 3,890,139 | | 6/1975 | Suzuki et al. | 75/74 |
| 4,139,371 | | 2/1979 | Makipirtti et al. | 75/73 |
| 4,169,725 | | 10/1979 | Makipirtti | 75/74 |
| 4,362,561 | | 12/1982 | Weigel et al. | 75/92 |
| 4,415,356 | | 11/1983 | Victorovich et al. | 75/21 |
| 4,470,845 | | 9/1984 | Yannopoulus | 75/23 |
| 4,940,486 | | 7/1990 | Sommerville et al. | 75/10.19 |
| 5,215,571 | | 6/1993 | Marcuson et al. | 75/626 |
| 5,312,525 | | 5/1994 | Pal et al. | 204/64 R |
| 5,314,524 | | 5/1994 | Pal et al. | 75/10.35 |
| 5,380,353 | | 1/1995 | Goto et al. | 75/640 |
| 5,406,969 | * | 4/1995 | Gray et al. | 137/13 |
| 5,449,395 | | 9/1995 | George | 75/586 |
| 5,527,374 | | 6/1996 | Pal et al. | 75/10.46 |
| 5,700,308 | | 12/1997 | Pal et al. | 75/10.1 |
| 5,888,270 | | 3/1999 | Edwards et al. | 75/643 |

FOREIGN PATENT DOCUMENTS

| | | |
|---|---|---|
| 1414769 | 11/1975 | (GB) . |
| 1525786 | 9/1978 | (GB) . |

OTHER PUBLICATIONS

Torres, N., *CIM Bulletin*, vol. 77, No. 871, Nov. 1984, pp. 86–91.

* cited by examiner

*Primary Examiner*—Melvyn Andrews
(74) *Attorney, Agent, or Firm*—Whyte Hirschboeck Dudek SC

(57) ABSTRACT

Copper matte is processed to anode copper without oxidizing blister copper in an anode furnace. Copper matte, in either molten or solid form, is fed to a continuous copper converting furnace in which it is converted to blister copper and slag. The blister copper and slag collect in the settler region of the furnace and separate into two phases, a blister copper phase and a slag phase (the latter floating upon the former). The converting furnace is equipped with means for stirring or agitating the interface of the blister copper and slag phases such that the sulfur content of the blister copper phase and the copper content of the slag phase are reduced.

11 Claims, 7 Drawing Sheets

$O_2$ ENRICHED AIR
+GRANULATED MATTE
FLUX
11
12
10
$N_2$
$N_2$
$N_2$
17a
17b
17c
15
16
2
2
13
14

$SO_2$(GAS)
15
16
14
$Cu_2S+2Cu_2O$
$6Cu^0$

PROCESS AND APPARATUS FOR THE CONTINUOUS REFINING OF BLISTER COPPER

This application claims benefit to U.S. application Ser. No. 60/074,515 filed Feb. 12, 1998.

BACKGROUND OF THE INVENTION

This invention relates to the production of copper. In one aspect, the invention relates to the pyrometallurgical production of copper while in another aspect, the invention relates to the pyrometallurgical production of copper using a continuous converting furnace. In yet another aspect, the invention relates to the pyrometallurgical production of copper using a continuous flash converting furnace equipped with a forebay.

The production of copper is ancient. Starting with finds of copper metal that were virtually ready for fabrication into various tools, man has learned over the millennia to recover essentially pure copper from ever more dilute ores (e.g. 0.2% or less copper). The two principal forms of copper production are pyrometallurgical and hydrometallurgical, the former the subject of this invention.

The pyrometallurgical production of copper is a series of multistep concentration, smelting, and refining procedures. Typically starting with an ore comprising one or more of a copper sulfide or copper-iron-sulfide mineral such as chalcocite, chalcopyrite and bornite, the ore is converted to a concentrate containing usually between 25 and 35 weight percent (wt %) copper. The concentrate is then converted with heat and oxygen first to a matte (typically containing between 35 and 75 wt % copper), and then to blister copper (typically containing at least 98 wt % copper). The blister copper is then refined, usually first pyrometallurgically and then electrolytically, to copper containing less than 20 parts per million (ppm) impurities (sulfur plus noncopper metals, but not including oxygen).

The conversion of copper concentrate to blister copper with heat and oxygen is known generally as smelting, and it comprises two basic steps. First, the concentrate is "smelted" to copper matte and second, the matte is converted to blister copper. Typically these steps are performed in separate furnaces, and these furnaces can vary in design. With respect to the first step, i.e. the smelting step, solid copper concentrates are introduced into a smelting furnace of any conventional design, preferably a flash smelting furnace, which is fired by the introduction of fuel and air and/or oxygen through a burner, and from which slag is tapped periodically and off-gases are routed to waste handling. In a flash smelting furnace, the copper concentrates are blown into the furnace through a burner together with the oxygen-enriched air. The copper concentrates are thus partially oxidized and melted due to the heat generated by the oxidation of the sulfur and iron values in the concentrates so that a liquid or molten bath of matte and slag is formed and collected in the basin (also known as the "settler") of the furnace. The matte contains copper sulfide and iron sulfide as its principal constituents, and it has a high specific gravity relative to the slag. The slag, on the other hand, is composed of gangue mineral, flux, iron oxides and the like, and it has a low specific gravity relative to, and thus floats on top of, the matte.

The molten copper matte and slag are separated in any conventional manner, typically by skimming the molten slag from the matte through tap holes in the furnace walls. The slag tapholes are located at an elevation on the furnace walls that allows slag withdrawal from the furnace without removal of molten matte. Tapholes for the molten matte are located at a lower elevation on the furnace walls that allows the withdrawal of molten matte without the withdrawal of slag. The molten copper matte is then either transferred directly or indirectly (e.g. by way of a holding furnace) to the converting furnace by any conventional means, e.g. launder or ladle, or its converted to solid form, e.g. granulated, for storage and later use as a feed to a converting furnace.

Converting furnaces are basically of two types, flash (also known as suspension) and bath, and the purpose of both furnaces is to oxidize, i.e. convert, the metal sulfides to metal or metal oxides. Representative bath furnaces include those used by Noranda Inc. at its Horne, Canada facility, by Mitsubishi Materials Corporation at its Naoshima, Japan facility, and by Inco Limited at its Sudbury, Canada facility. Representative flash converting furnaces include that used by Kennecott Utah Copper Corporation at its Magna, Utah facility.

Regardless of its design, the converting furnace contains a bath of molten blister copper which was formed by the oxidation of copper matte that was fed earlier by one means or another to the furnace. The bath typically comprises blister copper of about 50 centimeters in depth upon which floats a layer of slag of about 30 centimeters in thickness. If the furnace is a rotary bath-type, then the molten metal and slag, separately of course, are poured from a mouth or spout on an intermittent basis. If the furnace is stationary, then outlets are provided for the removal of both the slag and blister copper. These outlets include tapholes located at varying elevations on one or more of the furnace walls and in a manner similar to that used with the smelting furnace, each is removed from the furnace independent of the other.

Alternatively, the bath contents (i.e. the metallurgical melt) of the converting furnace is removed through a forebay or syphon which is attached to the furnace. The forebay is in open communication with the settler of the furnace by a passageway that allows for the continuous removal of both slag and blister copper. The slag and blister copper maintain their phase-separated relationship as they enter the forebay.

The forebay comprises a slag skimming chamber or zone equipped with a weir on one end and at least one tapping or overflow notch on at least one sidewall. The notch or notches is or are located at an elevation on the sidewall such that only slag enters and is removed from the forebay. The bottom of the notch(es) is(are) above the top surface of the metal product.

The weir of the forebay is located downstream from the slag overflow notch, and it is positioned (usually attached to both forebay side walls) such that it acts as a dam to the slag but not the metal product which underflows the weir to a point beyond the weir in the forebay referred to as the riser chamber or zone. The metal overflows this riser chamber through a metal overflow notch(es) on the end and/or side walls. In this manner, the molten metal product continuously overflows the end wall of the forebay into any means, e.g. a launder, tundish, etc. for transfer to another vessel (e.g. a holding furnace, an anode furnace, etc.).

Unlike a forebay, only blister copper enters a syphon. The opening between the syphon and the settler zone of the furnace is sized and positioned such that only blister copper has access to the syphon, i.e. the opening is positioned below the bottom surface of the slag layer. In this manner, the settler endwall acts as a weir relative to the slag gaining entry to the syphon. In these types of arrangements, the slag is removed through tapholes in the settler side or end walls.

The physical and chemical separation that occurs between the slag and blister copper is not complete and as such, the slag contains copper (usually in the form of cuprous oxide, i.e. $Cu_2O$, and copper metal, i.e. $Cu^0$) and the blister copper contains various waste and unrecovered mineral values, e.g. sulfur (principally in the form of cuprous sulfide, i.e. $Cu_2S$), ferrosilicates, cuprous oxide, etc. The copper in the slag is potentially lost metal value which is recovered by recycling the slag back to the smelting furnace. The waste and unrecovered mineral values in the blister copper are impurities which are eventually removed either in the anode furnace or through electrorefining.

The oxidation of copper sulfide at the interface of the slag and blister copper phases is known. However, the beneficial effect of this oxidation is minimized, particularly in stationary furnaces, by the relative quiescent state of the interface (because the activities of reacting sulfur and oxygen species must be high enough to produce sulfur dioxide at a pressure greater than that superimposed on the interface by the gas pressure in the furnace (about 1 atmosphere absolute) and the layer of slag above the interface (about 0.1 atmosphere absolute)). The oxidation will also be limited by the time in which the interface exists before the slag and blister copper are separated into different fractions.

Once the blister copper is separated physically from the slag, typically it is transferred by any suitable means, e.g. launder, ladle, etc., to an anode furnace for further pyrometallurgical refining (although in some instances, it may be transferred first to a holding furnace). Anode furnaces (not shown) are generally constructed as cylindrical vessels mounted on girth gear that enable them to rotate. They are generally equipped with a mouth to feed material, a burner to heat the contents, and tuyeres to feed gases into the metal bath. Tuyeres consist of pipes that pass through the vessel shell connected to supplies of inert, oxidizing, and reducing gases.. Blister copper in conventional operation is batch fed from ladles through the mouth of the vessel until a complete charge has been accumulated over a period of hours. During this time the burner is lit and maintains the charge in a molten condition.

Upon achieving a full charge that may weigh typically one hundred to six hundred tons, depending on the size of the furnace, the vessel is rotated one way into position so that the tuyeres are submerged beneath the metal surface and a sequence of gases are blown into the metal. Tuyeres may number typically between one and four depending on the size of the vessel.

The first sequence of gas blowing is termed the oxidation blow, consisting of the passage of mixtures of inert gas, air and oxygen into the blister copper to lower its sulfur content. The actual composition and volume of gases blown in this sequence is variable within limits and determined by the particular composition of the blister copper and the heat balance of the blowing operation. The desulfurizing operation is exothermic and the build-up of heat in the furnace can be controlled by varying the gas flow, and its inert (typically nitrogen) and oxygen content. In the process of this oxidation, slag is generated consisting of the remnants of iron, silica and other impurities from the prior smelting and converting processes. In some anode furnace sequences, the oxidation blow is usually split into two distinct steps separated by a slag removal stage. Slag is removed by turning the vessel back to its initial position, then continuing the rotation to the opposite side so that the mouth on the shell is low enough for slag to be poured off the surface of the metal into a suitable container. This collected slag is returned to the upstream process for valuable metals recovery. The furnace is then returned to its blowing position for further oxidation and removal of sulfur.

The sulfur is removed from the metal during the first sequence, or oxidation blow, as sulfur dioxide gas that evolves from the metal bath with unreacted oxygen and inert gases. The composition of this gas is low in sulfur dioxide, being typically 5,000 ppm during the initial blow when sulfur content is at a maximum, and dropping to less than 500 ppm when almost all of the sulfur has been removed. This gas is unsuitable for recovery of sulfuric acid and is neutralized and captured in gas scrubbing equipment.

The second sequence of gas blowing is called the reduction blow, consisting of the passage of inert and reducing gases (such as ammonia or natural gas/steam) into the desulfurized copper to reduce its oxygen content and form anode copper. The actual volume and composition of the gases blown during this sequence is again variable within limits, and determined by heat transfer and mass transfer considerations.

The conventional anode refining operation described in the foregoing paragraphs has the following disadvantages:

1. The operation is batch, with several stages that involve careful control and operator involvement.
2. In a continuous converting operation, the conventional batch anode refining operation introduces a potential bottleneck and can disrupt optimum converter operation.
3. The variable exhaust volume from the batch refining operation requires a gas system capable of a higher-than-average gas flow with consequent higher capital charges and operating costs.
4. The accumulation of blister copper at the commencement of the refining cycle, and the reheating of refined charges at the end of the refining cycle requires a high capacity oxygen-enriched burner for rapid heat input. The high temperature flame increases wear on the anode furnace refractory and produces a high thermal load on the gas handling system.
5. The inevitable variation in gas volumes introduced into the melt within the anode furnace during the different sequences of operation increases the potential for furnace refractory wear around the tuyere mouths. This leads to shutdowns to repair the refractory and the need for spare capacity in the form of additional anode furnaces that are expensive on capital and operating costs.
6. The need for multiple anode furnaces as a result of batch operation and intermittent maintenance adds to the complexity of mechanical and control systems.

By contrast with the shortcomings and limitations of conventional anode refining described above, this invention combines continuous converter operation with continuous refining furnace operation in the following ways and with the following advantages:

1. The anode refining furnace performs a continuous refining operation on a continuous stream of molten copper received directly from a continuous converting furnace or via an intermediate holding furnace. The blister copper enters at one end of the furnace and exits as refined anode copper at, or towards, the other end.
2. The superheat present in the continuous blister stream is utilized directly in the refining operation rather than be dissipated in the batch collection stage.
3. The residual sulfur in the blister copper stream is not removed in a separate oxidative stage but is removed to a degree determined by the initial oxygen content of the blister copper.

4. The level of sulfur in blister copper suitable for continuous refining is obtained as a natural feature of flash converting operation or as a result of subsequent additional removal in the continuous tapping device or intermediate holding furnace.
5. The level of oxygen in blister copper suitable for continuous refining is obtained as a natural feature of continuous converter operation, or if insufficient, is added in the form of a solid, oxygen-donating compound such as copper oxide or is added as gaseous oxygen. This insufficiency is corrected by addition to the stream leaving the continuous converter; while it is in transit to the anode furnace or holding furnace; while in the holding furnace; or while in the anode furnace; or by combinations of these methods.
6. The essentially continuous sulfur-bearing off-gas from the above continuous refining operation is beneficially routed to the process gas stream of the continuous converter, or associated smelting process. The majority of the sulfur dioxide is recovered as sulfuric acid.
7. Any tendency to form a copper oxide slag in the continuous refining operation is reduced by the presence of sulfur in the incoming feed. Any such slag formed in the furnace is re-mixed with the high sulfur blister at the feed end of the furnace to utilize the oxygen content of the slag.
8. The slag layer untimately formed on the melt being refined in the anode furnace is removed continuously or semi-continuously. Residual gangue in the incoming blister for example silica, lime, iron and alumina, together with some copper oxide and minor elements such as lead, bismuth and antimony, comprise the slag phase.
9. The slag properties are controlled by the optional addition of fluxing agents in any suitable manner, e.g. injection. The thickness of slag on the refining melt is controlled by the position of the slag removal device, such as notch, tap hole, underflow, according to known principles.

After the reduction step, the melt (i.e. anode copper) is cast into anodes for electrolytic refining to cathode copper (which typically contains less than about 20 ppm total impurities, e.g. sulfur, oxygen, arsenic, bismuth, antimony, silver, etc.).

While the present method of producing anode copper has evolved to a high state of both economic and environmental efficiency, improving operating efficiency is an eternal quest. One area of operation that lends itself to improvement is the operation of the anode furnace, specifically elimination of the oxidation stage. With the elimination of this stage, the throughput of the anode furnace can be significantly increased without any changes to the furnace itself. However to achieve this efficiency, the blister copper that is delivered to the anode furnace should ideally have less than about 500 ppm sulfur and less than about 4500 ppm oxygen. This in turn requires operating the upstream equipment, particularly the converting furnace in a manner that produces blister copper with sulfur and oxygen contents less than these numbers.

SUMMARY OF THE INVENTION

According to this invention, copper matte is processed to anode copper without separately oxidizing blister copper in an anode furnace. Copper matte, in either molten or solid form, is fed to a continuous copper converting furnace in which it is converted to, among other things, blister copper and slag. The blister copper and slag collect in the settler region of the furnace and separate into two phases, a blister copper phase and a slag phase (the latter floating upon the former). The converting furnace is equipped with means, preferably gas injection means, for stirring or agitating the interface of the blister copper and slag phases such that the sulfur content of the blister copper phase and the copper content of the slag phase are reduced. In those embodiments in which the furnace is equipped with a forebay, this stirring or agitating can also occur in the forebay (either in addition to or in place of that which occurs in the furnace). The resulting blister copper of reduced sulfur content is then fed to an anode furnace in which it is continuously refined to produce anode copper with less than 100 ppm sulfur content and typically less than 1500 ppm oxygen content.

In one embodiment, a melt comprising a slag layer floating on top of a blister copper layer, the slag layer containing an oxygen-containing species (e.g. copper oxide) and the blister copper layer containing a sulfur-containing species (e.g. copper sulfide) and a dissolved oxygen-containing species (e.g. dissolved oxygen), is mixed by introducing a gas into at least one of the slag and blister copper layers such that the sulfur-containing species in the blister copper reacts with either the oxygen-containing species in the slag or the dissolved oxygen-containing species in the blister copper to form copper metal and sulfur dioxide. The copper metal enters the blister copper layer, and the sulfur dioxide passes through and out of the slag layer. This mixing also promotes the transfer of any copper metal in slag to the blister copper, and the transfer of any mineral waste in the blister copper to the slag. Moreover, this mixing promotes the reduction of the sulfur dioxide partial pressure in the melt which, in turn, promotes the reaction of the sulfur-containing species with the oxygen-containing species, e.g. drives the copper sulfide/copper oxide reaction to the right, i.e. towards the production of the copper metal and sulfur dioxide.

In another embodiment, the gas is introduced into the blister copper by any convenient means, e.g. a porous plug, such that the gas rises to the interface of the molten blister copper and slag so as to increase turbulence or mixing at the interface. In another embodiment, the gas is introduced into the slag by any convenient means, e.g. a lance, such that the gas creates at least a partial turbulent mixing of the slag and blister copper layers. In yet another embodiment, the gas is introduced into both the molten blister copper and slag by any convenient means, e.g. a combination of porous plugs and lances, or porous-wall injectors, etc., so as to increase turbulence or mixing at the interface of the layers or phases. Although the gas is introduced into one or both phases in a manner that expands or blurs the interface between the slag and blister copper layers, it usually is not introduced in a manner that eliminates the slag phase as a separate, discernable phase. In those instances in which such mixing does occur, e.g. in the immediate vicinity in which the gas is injected into the slag from a lance, such time is allowed for the phases to reseparate before one is removed from the other, e.g. by tapping, etc.

In still another embodiment of this invention, the porous-wall injector used to introduce a gas into both the blister copper and slag layers comprises a perforated gas conduit with a first end adapted to receive gas from a gas source and a second end adapted for discharge of the gas, the conduit encased in a porous sheath, the sheath spaced apart from the conduit by at least one spacing means to form a first gas diffusion region. Optionally and preferably, the porous-wall injector further comprises a perforated support plate attached to the second end of the conduit, the support plate encased in a support block fitted with a porous plug located beneath and spaced apart from the support plate to form a second gas diffusion region. a gas conduit with gas pores encased in a refractory sheath. The gas is discharged into the surrounding metallurgical melt (both the blister copper and slag layers) through the perforations or gas pores of the conduit into and through the gas diffusion space and into and through the encasing porous sheath. The gas leaves the injector as a plume of bubbles that stirs or agitates the blister copper/slag interface.

In yet another embodiment of this invention, blister copper containing less than about 500 ppm sulfur is produced within a continuous copper converting furnace, the furnace comprising a settler zone and a molten blister copper/molten slag interface agitation means, the method comprising the steps of:

A. Feeding copper matte to the furnace, the furnace operated at conditions sufficient to convert the matte into molten blister copper and molten slag;

B. Converting within the furnace the matte to molten blister copper and molten slag;

C. Collecting the molten blister copper and the molten slag in the settler zone of the furnace such that the slag contains an amount of copper oxides and copper metal and floats upon and forms an interface with the molten blister copper, and the blister copper contains sulfur in excess of about 500 ppm;

D. Agitating the blister copper/slag interface with the blister copper/slag interface agitation means such that the sulfur content of the blister copper is reduced to less than about 500 ppm and the amount of copper oxides and copper metal in the slag is also reduced; and E. Removing the molten blister copper with the reduced sulfur content from the furnace.

In yet still another embodiment of this invention, an apparatus for producing anode copper containing less than about 100 ppm sulfur and less than about 1500 ppm oxygen comprises:

A. A continuous copper converting furnace for producing blister copper containing less than about 700 ppm sulfur and less than about 7000 ppm oxygen, the furnace having a (i) settler zone, (ii) molten blister copper/molten slag interface agitation means, and (iii) a forebay in open communication with the settler zone;

B. An anode furnace having blister copper reducing means for reducing the oxygen content of the blister copper produced in the continuous copper converting furnace to less than about 7000 ppm; and C. Blister copper transfer means for transferring the blister copper containing less than about 700 ppm sulfur from the forebay or tapping device of the continuous copper converting furnace to the anode furnace.

Regardless of the manner in which the blister copper is separated from the slag, e.g. through the use of tapholes, forebay or syphon, the sulfur content of the blister copper at the time it is transferred by any suitable means, e.g. launder, ladle, etc., to an anode furnace (either directly or indirectly, e.g. by way of a holding furnace), is less than about 700, preferably less than about 500 and more preferably less than about 300, ppm. In the anode furnace, the blister copper is reduced with a reducing gas, e.g. natural gas, hydrogen, ammonia, reformed gas, etc., to anode copper having an oxygen content less than about 3000, preferably less than about 2000 and more preferably less than about 1500, ppm.

DESCRIPTION OF THE PREFERRED EMBODIMENT

As here used, "metallurgical melt" or simply "melt" means the molten contents of a metallurgical vessel, e.g. a furnace, forebay, etc. The melt in the settler of a copper converting furnace typically comprises a slag phase floating on top of a blister copper phase. If a forebay is attached to and in open communication with the settler of the converting furnace, then the melt of the forebay is the same as the melt of the furnace (at least the same as that part of the melt in the settler near the entrance to the forebay).

Although the following description of the invention is in the context of a continuous flash converting furnace, this is but one embodiment of the invention. This invention is applicable in other embodiments, e.g. continuous bath converters, particularly quiescent bath converters, as well.

Various aspects of the invention are described by reference to the drawings in which like numerals are employed to designate like parts and features. Although various items of equipment, such as fittings, mountings, pipes, and the like, have been omitted so as to simplify the description, such conventional equipment can be employed as desired.

Figure 1:
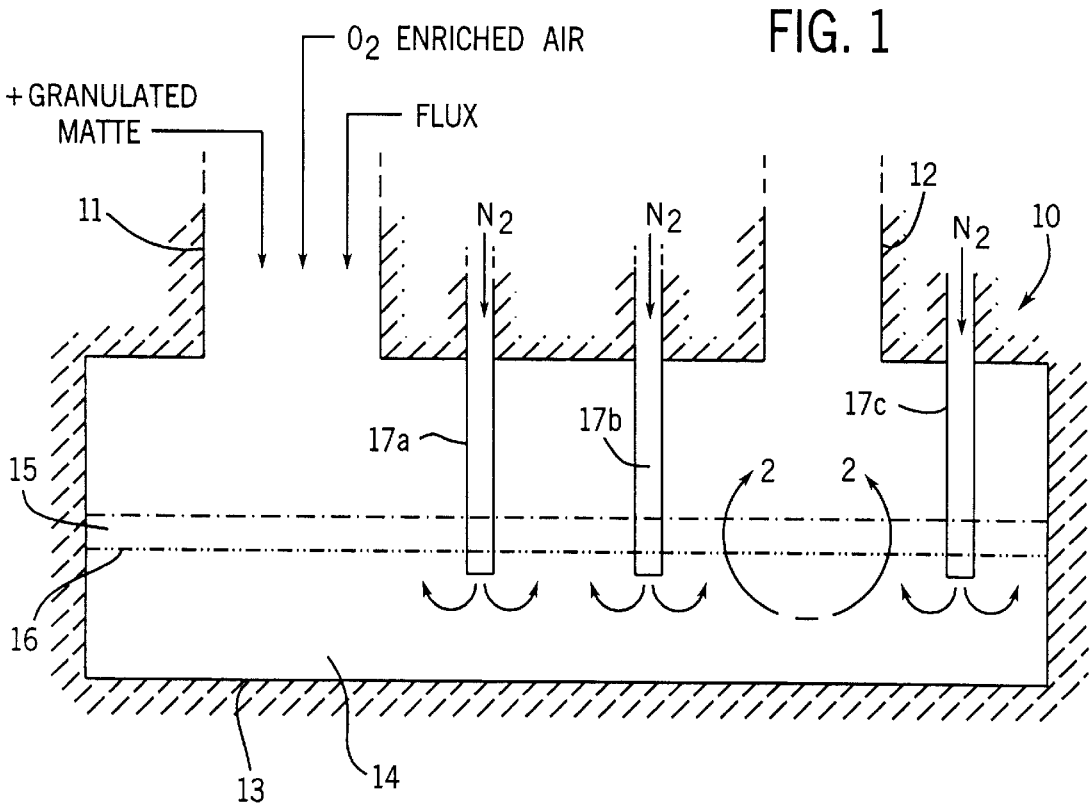
FIG. 1 is a side, cut-away view of a continuous flash converting furnace depicting molten slag floating upon molten blister copper.

In FIG. 1, continuous flash converting furnace 10 is equipped with a reaction shaft 11 and a riser (or uptake or offtake) shaft 12. Granulated matte, oxygen-enriched air and flux are mixed, melted and combusted within reaction shaft 11 to form blister copper and slag which drop into settler zone 13 of the furnace. Blister copper 14 pools within settler zone 13, and slag 15 floats on top of the blister copper (due to the fact that the slag has a lower specific gravity than does the blister copper) forming interface 16. Exhaust gases, which include sulfur dioxide, are vented from the furnace through riser 12. Representative flash converting furnaces include that used by Kennecott Utah Copper Corporation at its Magna, Utah facility. Flash converting furnaces are similar in construction and operation to flash smelting furnaces, and the latter are well described in the art, e.g. U.S. Pat. No. 4,139,371; 4,169,725; and 4,415,356, all of which are incorporated herein by reference. Other continuous furnaces (converting or otherwise), e.g. the INCO oxygen flash converting furnace and the Mitsubishi converting furnace, can also be used in the practice of this invention.

Solid copper matte (typically in finely divided form such as that produced from granulation and/or grinding), oxygen-enriched air and flux are mixed, melted and combusted within reaction shaft 11 to form blister copper and slag which drop into settler zone 13 of the furnace. Blister copper 14 pools within settler zone 13, and slag floats on top of the blister copper (due to the fact that the slag has a lower specific gravity than does the blister copper) forming interface 16. Exhaust gases are vented from the furnace through riser 11.

In the operation of a conventional continuous flash converting furnace, the slag and blister copper form a quiescent, two-phase pool within the settler region of the furnace. The slag will contain, among other things, gangue mineral, flux, iron oxides, copper oxides (principally in the form of $Cu_2O$) and copper metal ($Cu^0$), while the blister copper will contain, among other things, copper metal, copper oxides (also principally in the form of $Cu_2O$), copper sulfides (principally in the form of $Cu_2S$) and gangue mineral. The principal source of potentially lost copper values during the converting process is $Cu^0$ and $Cu_2O$ dissolved in the slag. Typically these copper values are recovered by recycling the slag to the smelting furnace.

Figure 2:
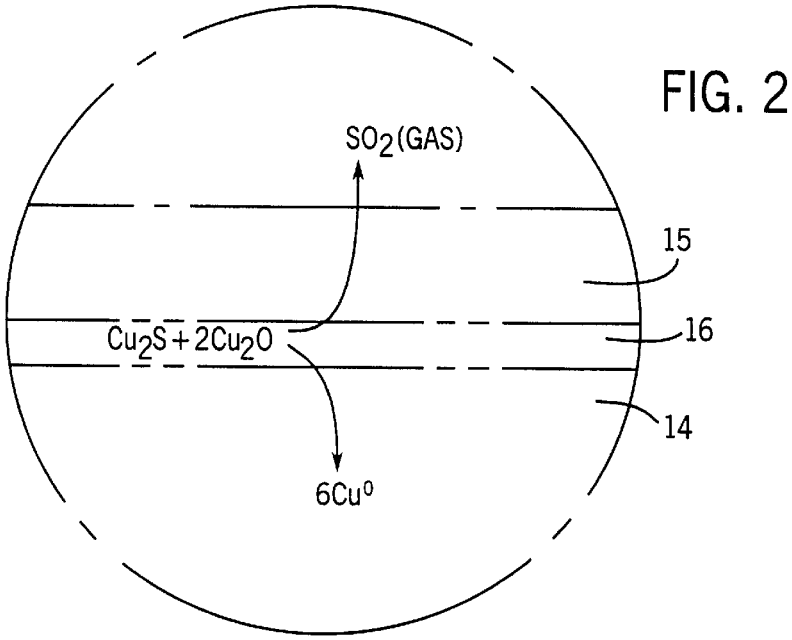
FIG. 2 is a magnified view of FIG. 1 within the circle identified by lines 2—2.

As shown in FIG. 2, cuprous sulfide and cuprous oxide react with one another at interface 16 of the slag and blister copper under normal operating furnace conditions (e.g. at a temperature between about 1100 C. and about 1500 C., preferably between about 1125 and about 1400 C. and more preferably between about 1150 and about 1350 C.) to form copper metal and sulfur dioxide ($SO_2$). The molten copper metal settles into the blister copper pool, and the sulfur dioxide passes through the slag layer into the freeboard above the layer for ultimate removal from the furnace through riser 12.

The efficiency of this reaction depends, in large part, upon the ability of sulfur-containing and oxygen-containing species (e.g. cuprous sulfide and cuprous oxide) to react with one another. While the path for this reaction is open to a number of interpretatins, one possible path is for the sulfur-containing species in the blister copper to contact the oxygen-containing species in the slag. Another possible path is for the sulfur-containing species in the blister to react with the oxygen-containing species in the blister upon gas injection which allows for sulfur dioxide formation at low partial pressures, e.g. less than one atmosphere. As the oxygen-containing species in the blister copper is depleted, oxygen-containing species in the slag will begin to diffuse into the blister copper effectively reducing the oxygen content of the slag. In this instance, the copper sulfide in the blister does not need to be in contact with the slag for the reaction to progress.

In the normal operation of a continuous flash converting furnace, the efficiency of the copper sulfide/copper oxide reaction is dependent upon, among other things, the amount of time the slag and blister copper phases are in contact with one another within the furnace, the amount of cuprous sulfide in the blister copper, the amount of cuprous oxide in the slag, the depth of the interface of the slag and blister copper layers, and the like. In the conventional operation of a continuous flash converting furnace, the amount of copper lost with the removal of the slag is typically between about 1 and about 5 weight percent (based on the weight of the copper in the matte (and any other source of copper fed to the furnace)), and the amount of cuprous sulfide in the blister copper is typically between about 5000 and about 20000 ppm (1000 to 4000 ppm sulfur equates to about 5000 to about 20000 ppm $Cu_2S$).

In one embodiment of this invention, cuprous oxide in any form (preferably in finely divided form) is added to the melt in any suitable manner (e.g. through a lance) if the amount of cuprous sulfide in the blister copper exceeds the amount of cuprous oxide in the slag necessary for complete reaction of all the available cuprous sulfide to copper metal. Likewise, cuprous sulfide in any form (preferably in finely divided form) is added to the melt in any suitable manner (e.g. through a lance) if the amount of cuprous oxide in the slag exceeds the amount of cuprous sulfide in the blister copper necessary for complete reaction of all the available cuprous oxide to copper metal. The relative amounts of copper sulfide and copper oxide in the melt are monitored by any convenient means to maximize the removal of oxygen and sulfur from the melt.

In a quiescent bath, mass transfer between the upper and lower phases is reduced over time because the phases at the interface become denuded of reactants. Diffusion of species to and from this region of the phases, i.e. those areas of the phases near the interface, slows with time. In one embodiment of this invention, the efficiency of the reaction described in FIG. 2 is enhanced, i.e. the rate of diffusion of species from one phase to the other is increased, by sparging at a point or points in the blister copper and near the interface a gas, preferably an inert gas such as nitrogen, argon, etc., although reactive gases such as oxygen, carbon monoxide, methane, etc., can also be used for the additional purpose of controlling or influencing the oxidation and/or reduction reactions occurring in the melt. If a reactive gas is used, preferably it is used in combination with an inert gas, particularly in a combination in which the inert gas comprises a majority of the gas introduced to effect mixing and the reduction of the partial pressure of sulfur dioxide.

As shown in FIG. 1, gas lances 17*a–c* pierce slag layer 15 and discharge a gas, here the inert gas nitrogen, at points below interface (also known as an emulsion) 16. The nitrogen bubbles to and through interface 16 and in the process of this bubbling, it promotes or induces mixing of the blister copper and slag. This mixing, in turn, promotes reaction of the excess sulfur in the blister copper with the excess cuprous oxide in the slag, which in turn simultaneously reduces the amount of cuprous oxide in the slag and the amount of cuprous sulfide in the blister copper.

Although the diffusional limitation is overcome by the enhanced mixing of the phases, another limitation on the reaction between the cuprous oxide and cuprous sulfide is the equilibrium inherent to this reaction. One of the products of this reaction, sulfur dioxide, accumulates under the hydrostatic pressure of the melt and as such, impedes the advance of the reaction. Injection of a gas into the melt not only mixes it (and thus increases the diffusion of species within the melt), but it also sweeps the sulfur dioxide from the melt (i.e., it reduces the partial pressure of the sulfur dioxide in the melt) into the freeboard of the furnace and eventually out of the furnace by way of the riser shaft. This removal of sulfur dioxide drives the cuprous sulfide/cuprous oxide reaction to the right, thus enhancing both the depletion of these species from the melt and the production of copper metal.

The number, placement and design of the lances (one important feature of which is the size and shape of the nitrogen plume that each creates) can and will vary with the design of the furnace, the amounts of cuprous oxide in the slag and cuprous sulfide in the blister copper, and the amount of time after sparging required for the emulsion to reseparate to an extent that will allow for an efficient removal of one layer from the other without entrained material from the other layer. Typically, the lances will be placed in a pattern about the furnace that will ensure optimum enhancement of the interface mixing of the layers (i.e. will minimize the number and size of stagnant areas) across the total area of the interface. One such pattern is arraying the lances across the width of the settler between the reaction shaft and the uptake shaft.

Variables such as bubble size, rate of gas injection, depth of gas injection relative to the interface, and the like can vary to convenience with the proviso that the integrity of the individual layers are not compromised to an extent that an efficient separation of the phases is significantly impeded. This sparging also enhances the settling of copper metal from the slag into the blister copper, especially in those situations in which larger droplets contact with one another and form even larger particles (i.e. the particles coalesce) which are more easily separated from the slag than any of the droplets individually.

In another embodiment (not shown), the lances are not in contact with either the blister copper or slag layer. In this embodiment, the end of the lance from which the gas is discharged remains above the top surface of the slag layer. The discharged gas impacts the slag layer with a force at least sufficient to cause the interface between the slag and blister copper layers to enlarge (deepen) and in certain embodiments, with sufficient force to virtually drive the slag layer beneath the lance into the blister copper layer so as to render indiscernible two separate phases, i.e. a slag phase floating on top of a blister copper phase.

As described above, the injection of the gas into the furnace (regardless of the location relative to the phases, i.e. regardless of whether the gas is injected into one or both phases and regardless of whether the gas is injected directly into a phase or above the slag phase) reduces the partial pressure of the sulfur dioxide in the melt and this, in turn, shifts the equilibrium of the reaction described in FIG. 2 to the right, i.e. it favors the production of copper metal and sulfur dioxide.

In another embodiment of this invention (which is not shown in the Figures), the gas is sparged into the blister copper from porous plugs located in the side walls and/or floor of the settler. While effective to the extent that the gas discharged from these plugs gently agitates the interface, this method of sparging is less favored (relative to sparging through top or sidewall mounted lances) for several reasons. First, plugs on the settler floor are more difficult to position relative to the interface (porous plugs are typically nonadjustable once installed whereas lances can be extended into or withdrawn from the metallurgical melt over a rather wide range). Second, since porous plugs are completely submerged within the blister copper, they are more susceptible to blockage than a lance. Third, anything installed on the floor or sidewalls of the settler are more difficult to maintain simply from the logistics of access to the part. Access for maintenance and repair of roof and sidewall mounted lances, on the other hand, is much more readily available.

Figure 3:
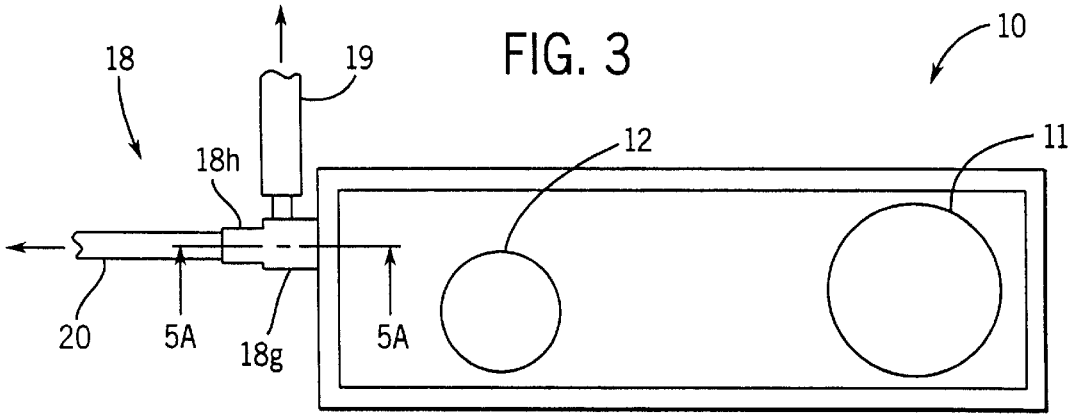
FIG. 3 is a plan view of a flash converting furnace attached to which is one embodiment of a forebay.
Figure 4A:
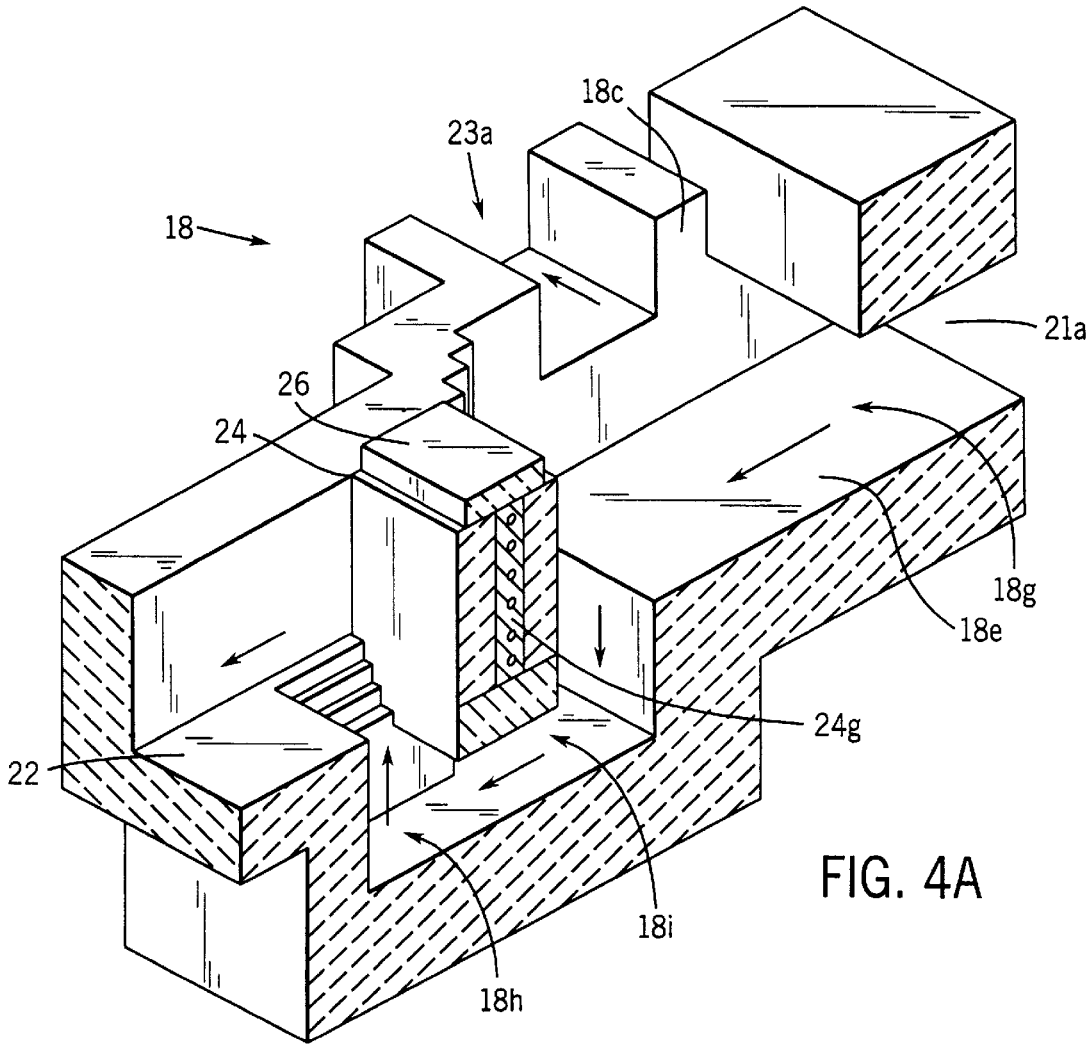
FIG. 4A is a top cross-section of the forebay of FIG. 3.
Figure 4C:
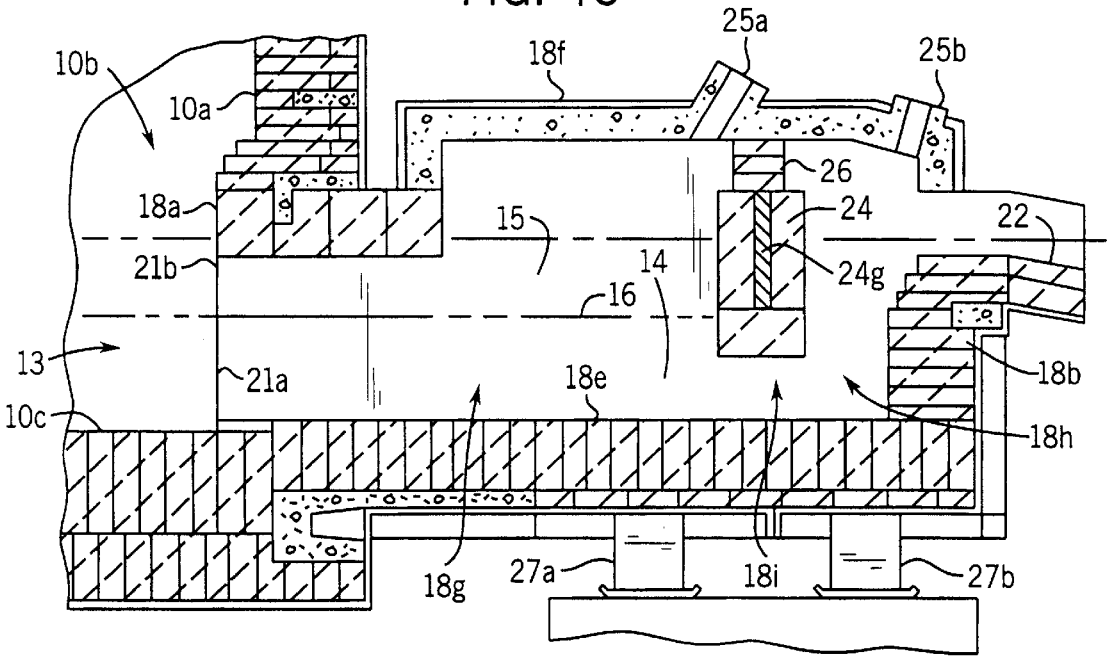
FIG. 4C is a side cross-section of another embodiment of the furnace and forebay of FIG. 3.
Figure 4B:
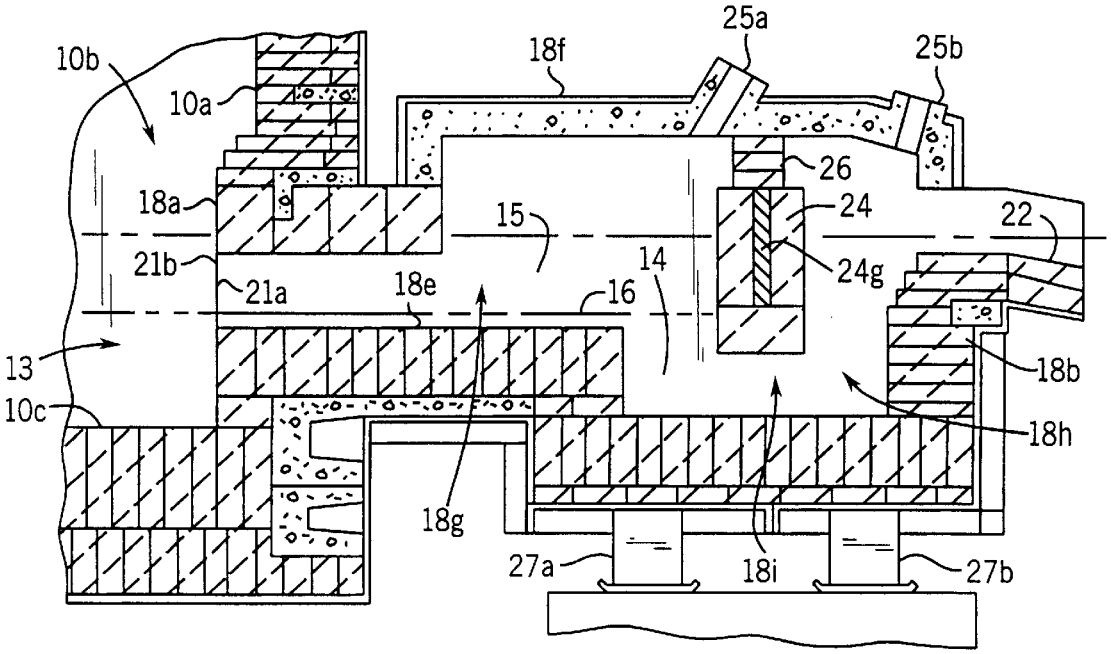
FIG. 4B is a side cross-section of one embodiment of the furnace and forebay of FIG. 3.
Figure 4D:
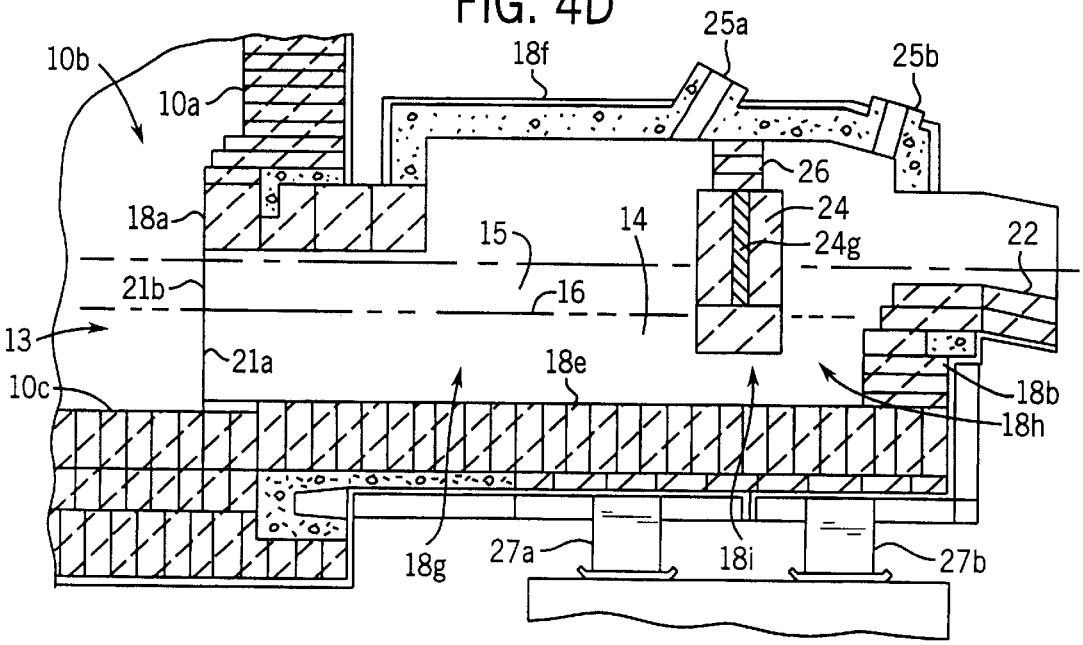
FIG. 4D is a side cross-section of another embodiment of the furnace and forebay of FIG. 3.
Figure 5B:
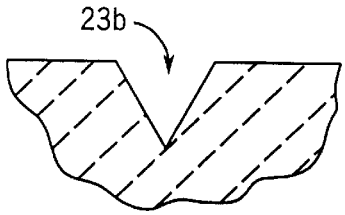
FIG. 5B is a side perspective of a V-shaped slag overflow notch.
Figure 5C:
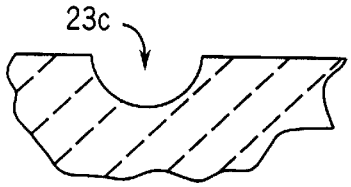
FIG. 5C is a side perspective of a nonlinear-shaped slag overflow notch.
Figure 5A:
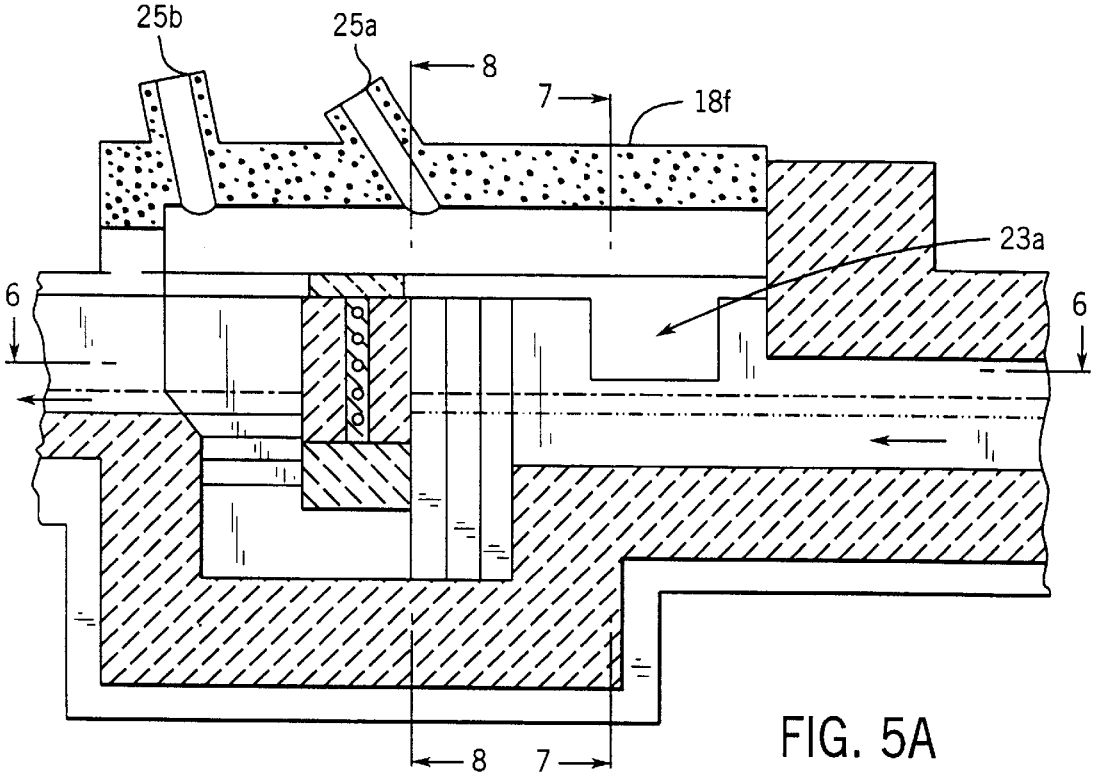
FIG. 5A is a side cross-section of the forebay of FIG. 3 along the line 5—5.
Figure 7:
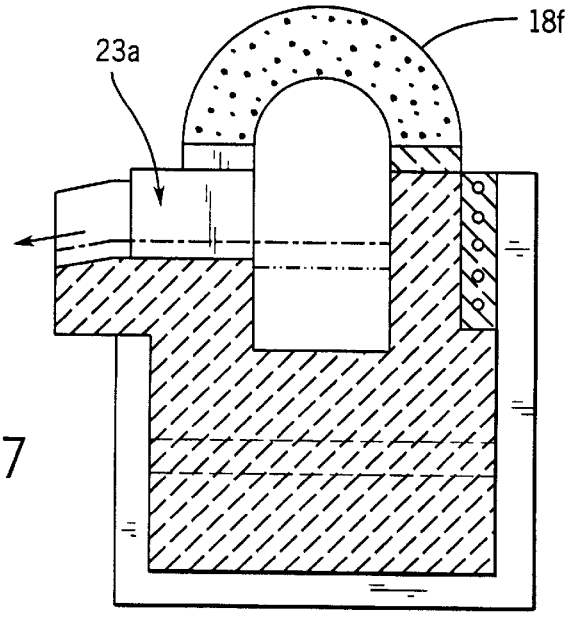
FIG. 7 is a front cross-section of the forebay of FIG. 5A along the line 7—7.

FIGS. 3–9 describe yet another embodiment of this invention. FIG. 3 shows a flash converting furnace 10 equipped with a reaction shaft 11 and a riser or an uptake shaft 12. Attached in any convenient manner to the converting furnace, typically on the end wall most removed from the reaction shaft, is forebay 18. The forebay comprises:

A. floor 18*e* (FIG. 4A);

B. first end wall 18*a* (FIGS. 4B–C) having entrance 21*a* (FIG. 4A) for receiving a two-phase melt, e.g. from converting furnace 10, the melt comprising slag phase 15 floating on top of and forming an interface 16 with metal product phase, e.g. blister copper, 14 (all shown in FIGS. 4B–D);

C. second end wall 18*b* (FIGS. 4B–D) opposite the first end wall, the second end wall having metal product overflow notch 22 (FIGS. 4A–D) for discharging the metal product from the forebay;

D. first and second sidewalls 18*c–d* (FIG. 6) joining the first and second end walls to one another, and at least one sidewall (here sidewall 18*c*) having slag overflow notch 23*a* (FIG. 4A) for discharging the slag phase from the forebay;

E. weir 24 having first and second faces 24*a* and 24*b*, first and second side edges 24*c* and 24*d* and top and bottom surfaces 24*e* and 24*f* (FIGS. 6 and 8), the first and second side edges in sealing contact with the sidewalls (i.e. the union or joint of the side edges and sidewalls is essentially impenetrable to both the slag and metal product) at a location between the slag overflow notch and the metal product overflow notch such that (i) the first face of the weir is opposite the entrance for receiving the melt and together with the forebay sidewalls, first end wall and floor forms slag skimming chamber (or zone) 18*g* (FIGS. 4A–D), (ii) the second face of the weir is opposite the metal product overflow notch and together with the forebay sidewalls, second end wall and floor forms riser chamber (or zone) 18*h* (FIGS. 4A–D), and (iii) the bottom surface of the weir and the forebay floor form underflow 18*i* (FIGS. 4A–D); and F. cover 18*f* (FIGS. 2B–D and 5) extending over the slag skimming and riser chambers.

Although typically a furnace requires only one forebay, a furnace may have more than one forebay and their locations on the furnace with respect to one another can vary to convenience. Multiple forebays can prove convenient in the context of achieving and maintaining maximum furnace operation time, e.g. when one forebay is out of operation for any reason, the other forebay(s) is(are) available to keep the furnace in operation. Multiple forebays may also be used to promote good metallurgical operation by preventing or reducing static layers (i.e. stagnant areas of slag or metal) from forming in parts of the furnace.

The forebay can form an integral part of the furnace, i.e. it can be built as an extension of the furnace, or it can be a separate unit, e.g. skid mounted but securely attached to a furnace wall in any conventional manner, e.g. bolted, mortared, etc., preferably with a water-cooled joint. However integrated or attached, ideally the forebay and furnace provide a single closed environment (except, of course, for the product and byproduct discharge zones) for the slag and molten blister copper. The forebay comprises slag skimming chamber (also known as a slag skimming zone) 18*g* connected to slag launder 19 (or in certain embodiments, a spout), and riser zone 18*h* connected to a blister copper launder (or in certain embodiments, a spout) 20.

One embodiment of forebay 18 is illustrated in cut-away perspective in FIG. 4A. Entrance 21*a* to forebay 18 is in open communication with furnace opening 21*b* (shown in FIGS. 4B–D) in end wall 10*a* of furnace 10 to which the forebay is attached. Opening 21*b* and entrance 21*a* are sized preferably such that both the blister copper and slag layers enter the forebay in the same manner in which they exist within furnace settler zone 13 (FIG. 4B–D), i.e. two relatively immiscible layers with the slag layer floating on top of the blister copper layer. Opening 21*b* is sized and located in furnace wall 10*a* at a height such that it is either completely submerged beneath the top surface of the slag layer within the furnace (shown in FIGS. 4B–C), or that a gas space exists between the top surface of the slag layer and the top surface of opening 21*b* (shown in FIG. 4D). In the first embodiment, the blister copper and slag form a gas seal between the environment of furnace freeboard zone 10*b* and the forebay environment. In the second embodiment, the gaseous environment of furnace freeboard zone 10*b* and the gaseous environment above the top surface of the slag within slag skimming zone 18*g* are in open communication with one another. The cross-sectional area and geometry of opening 21*b* and entrance 21*a* can be of any size and configuration, e.g circular, oval, polygonal, etc. and can be the same as or different from one another, but are typically sized and configured to allow the blister copper and slag layers to enter the forebay in a relatively undisturbed state, e.g. without significant fixing of the respective layers. The blister copper and slag layers move naturally toward and through the furnace wall opening 21*b* and entrance 21*a* into the forebay as a result of the slag and metal product phases seeking levels in relation to their overflow heights in the forebay.

The forebay is constructed of any suitable material(s), but typically it consists of a metal shell lined with refractory appropriate to working with molten blister copper and slag. The particular dimensions of the forebay are scaled to the size, capacity and design of the converting furnace (including the number and location of forebays ultimately attached to the furnace). The forebay may be equipped with devices, e.g. cooling blocks, resistance heaters, etc., not shown and optional to its operation.

After the molten blister copper and slag enter the forebay through opening 21*b* and entrance 21*a,* these materials proceed into slag skimming chamber 18*g* with the bottom surface of the molten blister copper layer in contact with floor 18*e*. Slag overflow notch 23*a* is located in slag skimming chamber side wall 18*c* at a height from floor 18*e* such that slag overflow notch 23*a* is above the slag/blister copper interface. The shape of the overflow notch can vary and in addition to the rectangular shape of 23*a* shown in the FIGS. 4A and 5, the shape of the notch includes a V-shape (23*b* in FIG. 5B) and various nonlinear shapes, e.g. semicircular (23*c* in FIG. 5C). In one embodiment of this invention (not shown), a slag overflow notch is located on side wall 18*d* (i.e. opposite the slag overflow notch shown in the Figures) while in another embodiment of the invention (also not shown), each side wall has one or more slag overflow notches (of the same or different cross-sectional configuration) located in the slag skimming zone. The size, i.e. the cross-sectional area, of the slag overflow notch can be enlarged or reduced during operation with the removal or addition of suitable materials to vary the height of the top surface of the slag phase in relation to the sidewall of the forebay.

Slag overflows from the slag skimming chamber 18*g* into and through overflow notch 23*a* into slag launder (or in certain embodiments, slag spout) 19. In one embodiment of this invention, the slag is collected in transportable vessels, e.g. ladle/crane assemblies, pots on rails, etc., while in another embodiment, the slag is immediately subjected to granulation by any convenient technique, e.g. water granulation, air granulation, rotating disk granulation, etc. The slag, in whatever form, is then recycled or otherwise processed for recovery of various metal values, or disposed in any safe and environmentally acceptable manner.

In one embodiment (shown in FIGS. 4A–B and 5), the forebay is stepped, i.e. it is characterized by the bottoms of opening 21*b* and entrance 21*a* located sufficiently above settler floor 10*c* such that a significant part of the blister copper bath within the settler cannot move into the forebay. The stepped design does require for separate draining of the settler zone below the bottom surface of opening 21*b,* but it also provides for retention of some, if not most, of the blister copper bath in the event the forebay is disabled for whatever reason.

In another embodiment, the forebay is full-depth, i.e. it is characterized by the bottoms of opening 21*b* and entrance 21*a* corresponding to or at a near approximation to furnace floor 10*c* (i.e. the floor of settler zone 13). As is evident from FIGS. 4B and 4C, the full depth forebay can be converted to a stepped forebay by the addition of refractory to floor 18*e*.

With respect to underflow 18*i,* in one embodiment it is in the form of a well or recess in floor 18*e* into which extends weir 24 (as illustrated in FIGS. 4A and 4B) while in another embodiment, it is simply an extension of floor 18*e* under weir 24 without a well or recess (as illustrated in FIG. 4C). In other embodiments (not shown), underflow 18*i* is a well in the floor of a full-depth forebay, e.g. the forebay illustrated in FIG. 4C but with a well below weir 24, or an extension of floor 18*e* in a stepped forebay, e.g. the forebay illustrated in FIG. 4B but without a well below weir 24 (and the bottom of weir 24, of course, sufficiently spaced above floor 18*e* to create a functional underflow). One advantage of the well configuration in both stepped and full-depth forebays is that the opportunities for slag to pass through to the riser zone are diminished.

Figure 6:
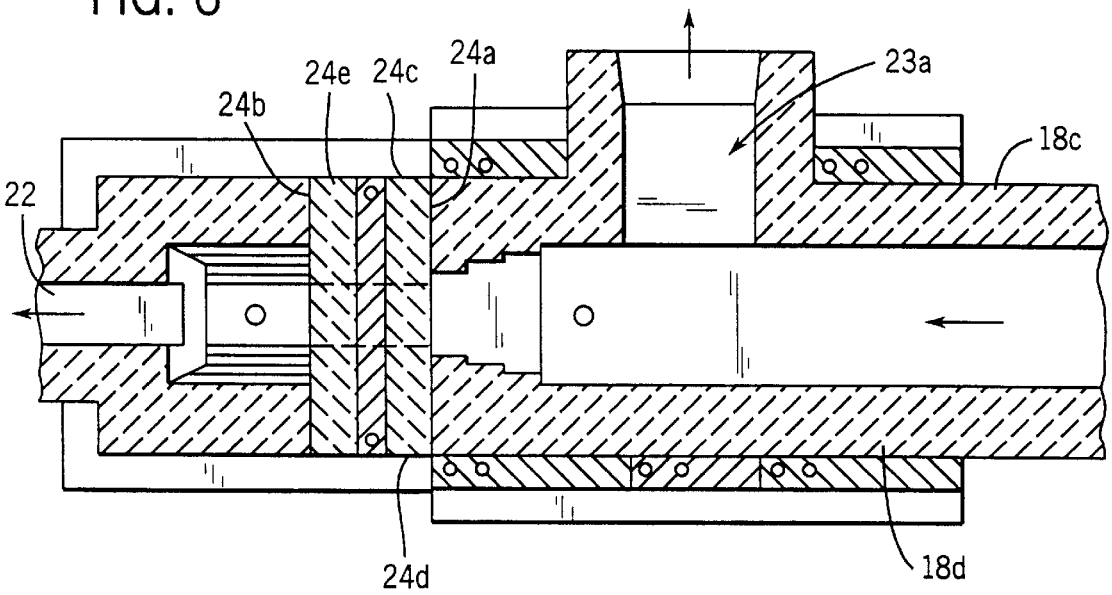
FIG. 6 is a plan cross-section of the forebay of FIG. 5A along the line 6—6.
Figure 8:
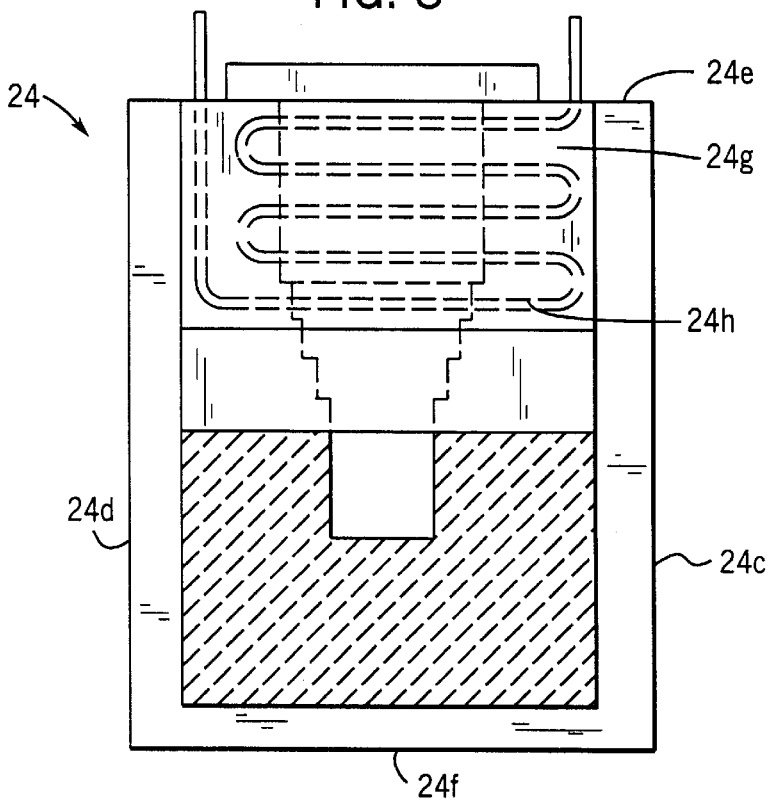
FIG. 8 is a back cross-section of the forebay of FIG. 5A along the line 8—8.

Underflow 18*i* is of any convenient configuration, and FIGS. 4A, 6 and 8 show the cross-sectional shape of one such configuration. This shape shows a generally rectangular configuration on that side of weir 24 nearest the slag overflow notch, and a generally tapered configuration on that side of weir 24 furthest from the slag overflow notch (this side known as riser zone 18*h*). The taper is narrowest at the recessed floor and widest at blister copper overflow notch 22. The stepped taper shown in FIGS. 4A, 5A, 6 and 8 is a preferred configuration because the relatively narrow bottom reduces heat loss and the relatively wide top facilitates heat input from any overhead heating device, e.g. burner, direct current arc, plasma torch, etc. Moreover, this configuration is relatively easy to construct from rectangular refractory bricks although like the cross-section of the slag overflow notch, this preferred taper can also have a V- or nonlinear cross-sectional shape. In another embodiment (as shown in FIG. 4C), floor 18*e* does not form a recess or well under weir 24.

Referring again to FIG. 4A, weir 24 extends into underflow 18*i* in such a manner as to block the passage of slag from slag skimming chamber 18*g* to blister copper overflow notch 22, but not the passage of molten blister copper from slag skimming chamber 18*g* to blister copper overflow notch 22. The distance between the floor of the recess under the weir and the bottom surface of weir 24 can also vary, but it is typically less than the depth of the molten blister copper layer as it passes through entrance 21*a*. The size of weir 24 is scaled to the size of the forebay itself, and the general configuration of weir 24 can also vary widely. The rectangular shape depicted in FIG. 4A is typical but in practice, the corners of the weir are likely to round over time due to erosion caused by the molten blister as it moves beneath it. Moreover, the width or thickness of the weir can also vary widely with such factors as ease of construction and maintenance of primary importance. Weir 24 contains cooling block 24*g* for purposes of extending refractory life. The lowest position (relative to top weir surface 24*e*) of bottom cooling passage 24*h* (FIG. 8) in cooling block 24*g* is preferably located above the level of the blister copper in the forebay (as illustrated in FIGS. 4B–D) so that if a water leak occurs, it does not leak into the blister copper (which could result in an explosion).

Due to the metallostatic pressure of the blister copper and slag within the furnace (which is analogous to hydrostatic pressure except that molten metal and slag is the liquid medium, not water), the blister copper will rise in riser zone 18*h* to a level intermediate between the top surface of the slag and the top surface of the blister copper within the slag skimming chamber. As such, riser lip, i.e. blister copper lip, 22 is located at a height below the top surface of the slag within the furnace, typically below the top surface of the blister copper within the furnace, to ensure that the blister copper continuously drains from the forebay. The blister copper overflows from riser lip 22 into launder or spout 20 for routing to another vessel, e.g. an anode or holding furnace.

During periods in which the molten phases are not flowing through the forebay, the static phases in the forebay (including those in the underflow and riser zone) are maintained in a molten state by a heating system of any convenient design. In one embodiment, one or more oxygen-fuel or plasma torches are employed while in another embodiment, an induction heater is used. The flow of molten material through the forebay is easily stopped by damming the overflow notch and blister copper overflow notch with refractory or clay.

The forebay is closed with cover 18*f* (FIGS. 4B–C and 7) which ideally forms a gas tight seal with the side walls of the forebay (with the understanding that openings exist for the discharge of slag and blister copper). Optionally, cover 18*f* is equipped with burners 25*a* and 25*b* to maintain the blister copper in a molten state. The burners can be of any conventional design, and are preferably located downstream from the slag overflow notch(es). If burners are employed in the cover, then the gases generated by them and the molten slag and/or blister copper must have a vent for their removal from the forebay. In those forebay designs in which a continuous gas space exists over the slag skimming chamber into the furnace, the gases in the forebay are naturally vented into the furnace freeboard zone due to the draft created by offtake shaft 12. In those forebay designs in which such a continuous gas space does not exist, then the forebay must be equipped with a vent port (not shown). Gases generated in the gas space above the blister copper in the riser zone are vented through the blister copper overflow notch and, of course, certain forms of heating, e.g. electric, generate less gas than others, e.g. burners.

To provide a more complete separation between slag skimming chamber 18*g* and riser zone 18*h*, divider 26 (typically constructed of refractory and illustrated in FIGS. 4A–D) is built between top weir surface 24*e* and the inside surface of cover 18*f*. Not only does this divider serve to provide distinct zones within the forebay, but it also forms a seal with respect to the gases above the slag and blister copper in slag skimming zone 18*g* and riser zone 18*h*, respectively.

To protect it against damage due to the natural movement of the furnace during operation, the forebay is optionally mounted on skid supports 27*a* and 27*b* (FIGS. 4B–D) and equipped with springs or similar devices (neither shown) to provide tensioning between it and the furnace. The forebay is also equipped with cooling blocks and other devices to prolong the life of its refractory and the placement of these structures can and will vary with the design of the forebay.

The phase levels within the forebay, and therefore within the furnace settler, are controlled by well known barometric relationships. Thus the barometric head of blister copper in the riser zone of the forebay balances the combined barometric heads of blister copper and slag in the slag skimming chamber. The level of blister copper in the furnace settler is preferably controlled by the height of the blister copper overflow notch relative to the forebay floor. This lip is always higher than the lowest point of the opening to/entrance of the forebay (e.g. the bottoms of opening 21*b* and/or entrance 21*a*). In addition to controlling the phase levels, this protects the settler refractory near and about the end wall opening to the forebay because blister copper, unlike slag, has a low corrosivity to refractory brick.

The level of blister copper above the bottom of the opening to/entrance of the forebay can be raised by raising the height of the blister copper overflow notch. The level of slag above the blister copper layer can be raised by raising the height of the slag overflow notch. Accordingly, the levels of the phases in both the forebay and the furnace settler can be controlled independently of one another for optimum metallurgical efficiency.

With respect to the slag layer, good metallurgical practice requires monitoring, by any conventional means, the size, i.e. depth, of this layer. If the slag layer becomes too deep, then it can push slag beneath the weir such that it under flows the weir and enters the riser zone from which it ultimately overflows into the blister copper launder or spout. The optimum depth of the slag layer will vary with a number of furnace design and operating factors.

In operation, molten slag and blister copper enter, due to the influence of gravity, the forebay from the converting furnace through opening 21*b* and entrance 21*a* in essentially the same arrangement in which they exist within the settler of the furnace, i.e. molten slag floating upon molten blister copper. If the molten slag and blister copper enter the forebay in a manner as illustrated in FIG. 4B, i.e. the top surface of the slag layer is above the top of the entrance to the forebay, then the forebay is "flooded". In this circumstance, a gas space in open communication with both the furnace and the forebay is not created, and a positive or negative pressure may be created within the furnace. If the molten slag and blister copper enter the forebay in a manner as illustrated in FIG. 4D, i.e. the top surface of the slag layer is below the top of the entrance to the forebay, then the forebay is not flooded. In this circumstance, a gas space in open communication with both the furnace and the forebay is created, and the pressure in the furnace and the forebay is essentially the same. In certain circumstances, operation of the furnace at a negative pressure relative to the forebay (or the surrounding environment, for that matter) is desirable because it results in certain operating efficiencies relative to energy usage product yield, etc.

The phase interface is relatively well-defined. As this two phase mixture moves into the slag skimming chamber, the molten slag layer is continuously removed due to overflowing through the slag overflow notch. The weir blocks the forward progress of the slag layer, and thus the only exit from the forebay for this layer is through the notch.

Since the weir does not extend to the slag skimming chamber floor, an underflow, i.e. gap or space, exists under the weir for the blister copper to move forward to the riser zone. However, since the weir does block the forward movement of the slag, only blister copper pools in the riser zone. Due to the metallostatic pressure of the molten blister copper and slag within the furnace, the blister copper will rise to a level intermediate between the top surface of the slag and the top surface of the blister copper in the slag skimming chamber and since this level is above the riser lip, i.e the blister copper overflow notch, the blister copper overflows the lip into the blister copper launder or spout.

In a preferred embodiment of this invention, the forebay is equipped with means for stirring or agitating the interface of the blister copper and slag phases such that the sulfur content of the blister copper phase is reduced, and the copper oxide and copper metal content of the slag phase is reduced. These means include mechanical agitators, e.g. paddles, stirrers, etc.; electrical agitators, such as induction stirrers; and gas agitators, e.g. lances, porous plugs, etc. Gas agitators are the means of choice for this invention, and porous-wall injectors and porous plugs are the preferred gas agitators.

In one embodiment, porous plugs are arrayed across the floor of the slag skimming chamber in any suitable pattern while in another embodiment, one or more porous-wall injectors are mounted to the roof or lid of the forebay in any suitable array over the slag skimming chamber such that when the lid is in a closed position, the porous injector(s) extends through the slag layer into the blister copper layer. The plugs and injectors can also be used in combination with one another. One or more gases, e.g. nitrogen or nitrogen in combination with an oxygen-containing gas, is discharged from the injector or plug in a manner that interface 16 is gently agitated or stirred. In these embodiments, the forebay is sized such that it can also accommodate the equipment (e.g. lances, porous plugs, etc.) and residence time necessary to effect this further processing. This may result in a forebay with physical dimensions larger than that required simply to drain and separate the melt as received from the furnace.

Figure 9:
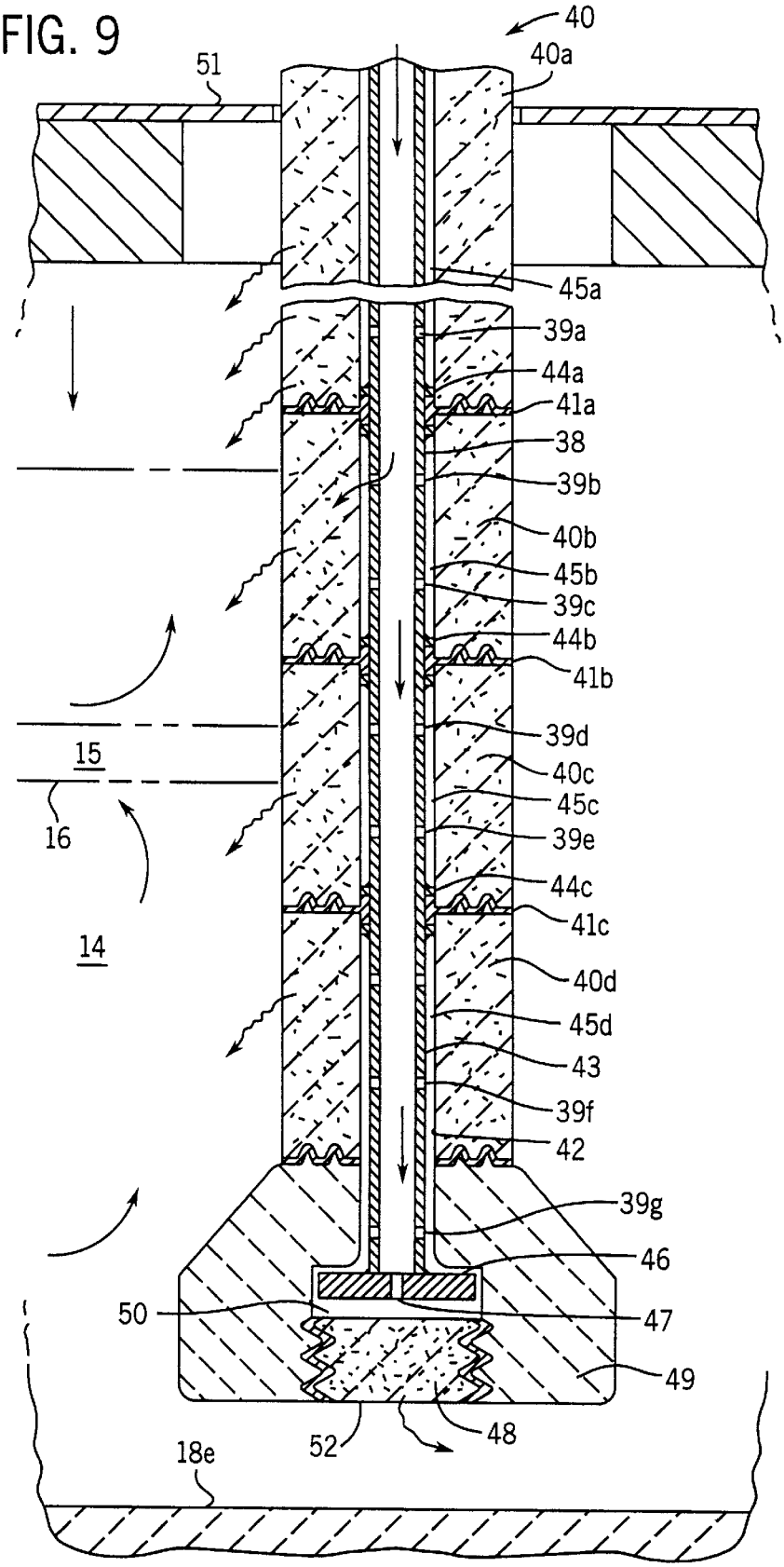
FIG. 9 is a side cross-section of a porous-wall injector.

The injector itself is shown in greater detail in FIG. 9. and it comprises pipe or other gas conduit 38 of any cross-sectional geometry containing gas holes or pores 39*a–g*. Pipe 38 is encased in but spaced from porous refractory shroud 40 which comprises porous refractory segments 40*a–d* which are joined to one another by grouted labyrinth joints 41*a–c*. Inner surface 42 of porous refractory shroud 40 is spaced from outer surface 43 of pipe 38 by spacers 44*a–c* to form gas diffusions spaces 45*a–d*. Pipe 38 extends from a gas source (not shown) located external to the forebay to support plate 46 itself containing at least one gas pore 47. Beneath support plate 46 is bottom porous plug 48, and the end of pipe 38, support plate 46 and bottom porous plug 48 are encased in injector support block 49. Support plate 46 and bottom porous plug 48 are positioned one from the other within injector support block 49 such as to create gas diffusion space 50. To ensure a gas tight seal, the injector passes through sealing plate 51 which is attached by any suitable means (e.g. welding, mechanical fasteners, etc.) to the forebay roof or lid. Sealing plate 51 is protected from the heat and corrosion of the metallurgical melt, of course, by a suitable refractory shield.

In another embodiment not shown, the injector further comprises a means for injecting a finely divided solid into the melt. Representative of this embodiment is an injector which comprises two concentric conduits, e.g. tubes or pipes. The finely divided solid is injected into the melt through the inner conduit, and the gas is injected into the melt through the annulus defined by the outer surface of the inner conduit and the inner surface of the outer conduit. In this regard, the porous-wall injector can be used as a means for adding, for example, copper oxide to the melt in those situations in which the melt contains an insufficient amount of copper oxide to react with the amount of copper sulfide in the melt. As another example, the porous-wall injector can be used as a means for adding copper sulfide to the melt in those situations in which the melt contains an insufficient amount of copper sulfide to react with the amount of copper oxide in the melt.

In practice, porous-wall injector 37 extends from the roof or ceiling of forebay 18 (and in other embodiments of this invention, and/or from the ceiling of furnace 10) into and through slag layer 15 and interface 16, and into blister copper layer 14 such that bottom surface 52 of bottom porous plug 48 is positioned near (e.g. within 15 cm) slag skimming chamber floor 18*e*. Gas is fed through pipe 38 under sufficient pressure (e.g. between about 10 and about 100 psi) such that not only does it discharged through all of the gas pores along the length of pipe 38 (and thus into gas diffusion spaces 45*a–d* and 50), but it also discharges through all of the porous refractory adjacent gas diffusion spaces 45*a–d* and 50 to create a desired plume about the exterior of the injector.

The embodiment of a porous-wall injector provides a number of benefits with respect to stirring gently the interface that are not available from standard lances or porous plugs. First and foremost, because the porous-wall injector discharges gas from near its entire length and not just from its bottom plug (as would a lance), the gases stir all of the material about the injector. Thus not only is the interface stirred from the blister copper layer, but it is also stirred from the slag layer (as opposed to either a lance or a porous plug which will stir only the layer in which its discharge opening is located (typically the blister copper layer)). Moreover, by stirring both layers over their entire depths, the gases create currents within each layer that result in more volume from each layer coming into contact with more volume of the other layer (and thus more opportunity for the cuprous sulfide and cuprous oxide to react with one another, and more opportunity for copper metal to settle into the blister copper layer and more opportunity for slag mineral values to rise into the slag layer).

Second, since the porous-wall injector is engulfed in its own gas plume, it suffers less corrosive wear than a porous plug or lance because the gas plume not only stirs the material surrounding the injector, but it also keeps it spaced from the surface of the injector. In other words, the discharged gas acts also a protective envelope about the injector, thus extending its useful life. Moreover, this is true, i.e. the forming of a protective and cooling envelope, in the freeboard space above the metallurgical melt in which the injector is otherwise in contact with the corrosive gases (e.g. $SO_2$) and entrained molten solid particles of slag and semi-melted concentrate generated by the pyrometallurgical process prior to their removal from the furnace.

Third, by discharging the gases over near the entire length of the injector, more volume of gas can be injected into the melt in a more gentle manner than could a similar volume of gas through a smaller discharge port (such as those of a lance or porous plug). Thus more stirring is achieved with less likelihood of destruction of the individual phases.

Other benefits of this invention include the reduction in the partial pressure of sulfur dioxide (which in turn drives the chemistry of the reaction of cuprous sulfide and cuprous oxide to produce copper metal and sulfur dioxide), increased heat transfer from gases above the bath through the slag layer into the blister copper layer, lower corrosivity of the slag due to a reduced copper oxide content, improved fire refining due to a lower sulfur content in the blister copper, improved sulfur capture in the converting furnace (which in turn means less scrubbing of subsequent fire refining off gases is required), and a slag phase with a lower metallic copper content due to the improved droplet coalescence.

The porous-wall injectors of this invention can be used alone or in combination with one or more lances and/or one or more porous plugs. Preferably the porous-wall injectors are used alone, at least with respect to stirring the blister copper/slag interface (as opposed to using the lances and/or plugs for another purpose, e.g. introducing an oxidant into the blister copper or a reductant into the slag).

The following description of the integration of continuous anode refining into a continuous copper smelting and converting operation will expand on the points noted above. In a preferred embodiment of continuous anode refining, blister copper is continuously fed from a continuous copper converter via a forebay or other tapping device. The blister copper is preferably continuously fed by gravity through a heated metal launder to a suitable feed point in the anode furnace. In an optional embodiment, the blister copper passes through an intermediate holding furnace.

In this preferred embodiment, gases from the continuous tapping device; the optional holding furnace; and the interconnecting metal launders are collected and routed into a process gas system. In one embodiment the process gas system can be that from the continuous converter. In another embodiment, the process gas system can be that from other smelting processes of convenient location. In yet another embodiment, the process gases can be from the continuous anode refining furnace that are subsequently directed into yet another process gas system. In all these embodiments the principle of operation is the beneficial recovery of the sulfur dioxide content of low grade gases from the continuous tapping device; metal launders; holding furnaces; and continuous anode refining furnaces by ducting them into a process gas system of higher gas strength. The subsequent dilution of process gas can be tolerated subject to the limitations set by the associated acid plant. For example, the flash smelting furnace and flash converting furnace installed at the Magna smelter of the Kennecott Utah Copper Corporation produces process off-gas containing sulfur dioxide at 35–40% by volume. This gas is subsequently diluted to the maximum concentration of 14% acceptable to the associated acid plant.

In a preferred embodiment, the sulfur content of blister copper entering the anode furnace is less than 500 ppm and the oxygen content is less than 5,000 ppm. In a further embodiment, the sulfur content is less than 300 ppm and the oxygen content is less than 5,000 ppm. Preferably the blister copper achieves these levels before leaving the flash converter. However, if the sulfur level is higher than the preferred 500 ppm, it can be reduced to this level, or to the more preferred level of less than 300 ppm by nitrogen injection into the continuous tapping device; or metal launder; or holding furnace. This nitrogen injection can be supplemented by the injection of air or oxygen by known methods, e.g. lances, to further reduce the level of sulfur.

Upon receipt of blister copper with this preferred analysis, it is fed into the anode furnace by any suitable means, e.g. through a launder in the end of the anode furnace, or through a drop hole in the uppermost surface of the cylinder body of the anode furnace. By these means, blister copper is added to the melt in the anode furnace that is undergoing continuous refining.

The blister copper preferably enters the melt in the anode furnace at the opposite end to the point of discharge of refined anode copper. It does this to maximize the distance along the furnace through which it must travel while being progressively refined. This principle of operation is most important when the residence time is short, i.e. when the anode furnace is small and the level of melt in the furnace is low. On the other hand, if the furnace capacity is large, then the residence time increases, and it is not as important to separate the feed and discharge points at opposite ends of the furnace. In an extreme case, the residence time will be adequate to refine blister copper with no concentration gradient along the length of the anode furnace, i.e. the bulk concentration of the melt in the anode furnace is in all places equal to the composition of refined anode copper. The blister copper can then be added at any point that does not short-circuit the furnace.

For example, at the Magna smelter the anode furnaces have a capacity of 600 tons of blister copper. The following table of actual operating data shows the initial and final compositions of the reduction blow, i.e. the removal of oxygen with the tuyeres feeding a mixture of natural gas and steam.

| Sulfur at Start ppm | Oxygen at Start ppm | Reduction Time Hours | Sulfur at End ppm | Oxygen at End ppm |
|---|---|---|---|---|
| 704 | 5629 | 3.0 | 23 | 944 |
| 575 | 6707 | 2.15 | 10 | 1124 |
| 522 | 7757 | 3.15 | 9 | 752 |
| 443 | 7902 | 1.5 | 25 | 1038 |
| 406 | 5798 | 2.5 | 21 | 1043 |
| 405 | 6950 | 2.0 | 9 | 987 |
| 323 | 3713 | 1.5 | 25 | 1278 |
| 293 | 5740 | 2.0 | 10 | 1213 |
| 238 | 6434 | 1.5 | 67 | 1083 |

As is apparent from this data, levels of sulfur up to 700 ppm can be effectively removed in 3 hours or less and that oxygen levels of up to 7,000 ppm can be reduced to the final target of 1,500 ppm or less in the same time. Analysis of oxygen removal shows that, if the melt is maintained at the final anode composition of 1,500 ppm or less by addition of blister copper of aobut 5,000 ppm, the rate of oxygen removal by normal tuyere injection rates is equivalent to a furnace residence time of around 6 hours. For the furnace feed rate of 60 tons per hour of blister copper, the time-averaged residence time is 10 hours for a 600 ton melt, indicating sufficient time to refine blister copper continuously to anode copper containing less than about 30 ppm sulfur and 1,500 ppm oxygen. Thus, subject to the blister copper not exceeding around 700 ppm sulfur and around 5,000 ppm oxygen, continuous refining of blister copper is achieved. Higher levels of sulfur and oxygen can be accommodated by increasing the number of tuyeres and/or increasing the gas blowing rate in the tuyeres.

In the practice of this invention, the sulfur values in the blister copper are continuously subjected to oxidation until reduced to less than about 700, preferably less than about 500, more preferably to less than about 100 and even more preferably to less than about 50 ppm (the lower the sulfur content of the blister copper, the easier the subsequent refining). This continuous oxidation is accomplished by the stirring or agitation of the blister copper/slag interface with a gas while the phases remain in the settler region of the furnace and, optionally, while the phases remain in contact with one another in the forebay (in those embodiments in which the phases are separated through the use of a forebay). In those embodiments in which the phases are separated while in the settler region of the furnace, e.g. by way of tapholes or a syphon, then, of course, this continuous oxidation occurs only within the furnace. The oxidation that occurs as a result of the interface stirring can be supplemented, if desired, by a conventional oxygen blow via tuyeres or lances. This technique addresses those situations in which the balance of oxygen and sulfur in the melt is not optimal for reaction with one another. In this situation, the addition of oxygen or natural gas (or some other reducing agent) into the interface can redress this balance problem. In any case, the sulfur content of the blister content is monitored such that it is not removed from the furnace or forebay, as the case may be, until it is reduced to less than about 700 ppm.

Furthermore, sulfur removal can be supplemented by stirring or agitation in the metal launders and holding furnace(s) during its continuous passage to the anode furnace. One, or a combination, of these methods can be used to effect the reduction of sulfur levels into the preferred range.

The copper converting furnace is operated in any known manner such that the oxygen content of the blister copper does not exceed about 7000, preferably 5000, ppm by the time that it (the blister copper) is ready for transfer from the forebay to the anode furnace (or an intermediate vessel, e.g. a holding furnace between the forebay and the anode furnace). Once transferred to the anode furnace (more than one of which may by connected, directly or indirectly, by launder, ladle or other means, if not directly to the forebay, then to the settler zone of the furnace), reduction can begin immediately since the sulfur content of the blister copper is already reduced to an acceptable level, i.e. less than about 500 ppm. In other words, the oxidation step is eliminated. The blister copper is subjected to reduction by contact with a reducing gas in any conventional manner to produce anode copper with an oxygen content of less than about 4000, preferably less than about 3000 and more preferably less than about 2000, ppm. The sulfur content of the anode copper at the time it is discharged from the furnace is preferably less than about 50 ppm.

Although the invention has been described in considerable detail through the preceding embodiments, this detail is for the purpose of illustration. Many variations and modifications can be made without departing from the spirit and scope of the invention as described in the appended claims.

What is claimed is:

1. A method of producing blister copper containing less than about 700 ppm sulfur within a continuous copper converting furnace, the furnace comprising a settler zone and a molten blister copper/molten slag interface agitation means, the method comprising the steps of:

A. Feeding copper matte to the furnace, the furnace operated at conditions sufficient to convert the matte into molten blister copper and molten slag;

B. Converting within the furnace the matte to molten blister copper and molten slag;

C. Collecting the molten blister copper and the molten slag in the settler zone of the furnace such that the slag contains an amount of copper oxides and copper metal and floats upon and forms an interface with the molten blister copper, and the blister copper contains sulfur in excess of about 700 ppm;

D. Agitating the blister copper/slag interface with the blister copper/slag interface agitation means such that the sulfur content of the blister copper is reduced to less than about 700 ppm and the amount of copper oxides and copper metal in the slag is also reduced; and E. Removing the molten blister copper with the reduced sulfur content from the furnace.

2. The method of claim 1 in which the blister copper/slag interface agitation means is a gas.

3. The method of claim 1 in which the blister copper/slag interface is agitated within the settler zone of the furnace.

4. The method of claim 1 in which the furnace is further equipped with a forebay that is attached to and is in open communication with the settler zone, and the blister copper/slag interface is agitated within the forebay.

5. The method of claim 1, 2, 3 or 4 in which the blister copper with the reduced sulfur content is removed from the furnace to an anode furnace in which it is subjected to reduction by contact with a reducing gas without first subjecting it to oxidation by contact with an oxidizing gas.

6. The method of claim 1, 2, 3 or 4 in which the sulfur content of the blister copper is reduced to less than about 300 ppm in step (D).

7. An apparatus for producing anode copper containing less than about 700 ppm sulfur and less than about 2000 ppm oxygen, the apparatus comprising:

A. A continuous copper converting furnace for producing blister copper containing less than about 700 ppm sulfur and less than about 7000 ppm oxygen, the furnace having a (i) settler zone, (ii) molten blister copper/molten slag interface agitation means, and (iii) a forebay in open communication with the settler zone;

B. An anode furnace having blister copper reducing means for reducing the oxygen content of the blister copper produced in the continuous copper converting furnace to less than about 2000 ppm; and C. Blister copper transfer means for transferring the blister copper containing less than about 700 ppm sulfur from the forebay of the continuous copper converting furnace to the anode furnace.

8. The apparatus of claim 7 in which molten blister copper/molten slag interface agitation means is at least one lance for introducing a gas into a pool of molten blister copper collected in the settler zone of the furnace.

9. The apparatus of claim 7 in which molten blister copper/molten slag interface agitation means is at least one porous-wall injector for introducing a gas into a pool of molten blister copper collected in the settler zone of the furnace.

10. The apparatus of claim 7 in which the molten blister copper/molten slag interface agitation means is at least one porous-wall injector for introducing a gas into a pool of molten blister copper collected in the forebay of the furnace.

11. The method of claim 1 in which the furnace is a continuous flash copper converting furnace.

* * * * *